United States Patent [19]

Venge

[11] Patent Number: 4,890,546

[45] Date of Patent: Jan. 2, 1990

[54] VENTILATION COWL

[76] Inventor: Vidar Venge, Porsvegen 1, N-5355 Knarrevik, Norway

[21] Appl. No.: 162,336

[22] PCT Filed: Jun. 24, 1987

[86] PCT No.: PCT/NO87/00051

§ 371 Date: Feb. 18, 1988

§ 102(e) Date: Feb. 18, 1988

[87] PCT Pub. No.: WO88/00269

PCT Pub. Date: Jan. 14, 1988

[30] Foreign Application Priority Data

Jun. 27, 1986 [NO] Norway ..... 862600

[51] Int. Cl.[4] ..... F24F 7/02

[52] U.S. Cl. ..... 98/42.06; 52/199; 98/42.11; 98/42.22; 98/66.1

[58] Field of Search ..... 98/42.06, 42.11, 42.12, 98/42.17, 42.19, 42.22, 66.1, 86.5; 52/199

[56] References Cited

U.S. PATENT DOCUMENTS

| | | | |
|---|---|---|---|
| 2,711,682 | 6/1955 | Drechsel | 98/42.11 |
| 2,741,972 | 4/1956 | Pryne | 98/42.12 X |
| 3,085,490 | 4/1963 | Field | 98/42.12 X |
| 3,199,433 | 8/1965 | Busma, Jr. | 98/42.06 |
| 3,579,930 | 5/1971 | Murphy | 98/42.22 X |

FOREIGN PATENT DOCUMENTS

| | | | |
|---|---|---|---|
| 2331754 | 6/1977 | France | 98/42.06 |

*Primary Examiner*—Harold Joyce

*Attorney, Agent, or Firm*—Kenyon & Kenyon

[57] ABSTRACT

A ventilation cowl for arrangement on a house roof. The cowl comprises a plate-shaped member which is adapted to form an abutment against the roof and which is designed with one or more openings for the reception of air ducts. The cowl further comprises a superstructure which covers the openings and at least a portion of the plate-shaped member. The superstructure is divided into two chambers by means of a partition wall, namely an approximately closed inner chamber and an aired outer chamber. An outlet union from an air duct passes through the partition wall and empties on the outer side of the partition wall in the outer chamber. By means of the ventilation cowl condensation which has a tendency to be formed on the inner side of the cowl is readily expelled. The inner chamber can form an inlet chamber to a fan which is received in the inner chamber, so that one or more air ducts can be readily connected to the inner chamber to be served by the fan.

7 Claims, 2 Drawing Sheets

VENTILATION COWL

The present invention relates to a ventilation cowl for arrangement on a roof of a house.

A problem with many known ventilation cowls is that rain water or other moisture can penetrate into the cowl and that condensation drips from the inner roof of the cowl and runs downwardly along the inner walls of the cowl and is collected in the ventilation cowl or by members connected to the latter.

A ventilation cowl in which the problem mentioned is reduced is shown in Norwegian Patent Application 840941. In the known construction referred to one is however dependent on a ventilation fan in each air duct, so that the exhaust air can be pushed upwardly through the discharge ducts to the ventilation cowl. The reason for this is that in the chamber in the cowl, into which the discharge ducts outlet, there is not obtained sufficient natural pressure. There is generally a problem of ensuring sufficient pressure simultaneously with the prevention of the penetration of moisture into the ventilation cowl to vital parts in the latter.

The object of the present invention is to provide a ventilation cowl where the problems with condensation can be avoided or at least largely reduced.

It is another object of the invention to provide for easy access to the internal parts of a ventilation cowl.

Further the aim is a solution where ventilation fans do not necessarily have to be employed in connection with discharge duct or ducts, the objective being to make provision for effective natural pressure in and around the ventilation cowl.

The ventilation cowl according to the invention is characterised in that it is partitioned into an inner, approximately closed chamber and an outer, airable chamber with associated openings to fresh air, by means of a vertical or substantially vertical partition wall which forms support for one or more outlet union(s) from associated air duct(s), the air duct(s) being connected to the outlet union via the inner chamber and the opening in the bottom-shaped member, while the outlet union(s) is/are preferably directed obliquely outwards and downwards in the outer chamber.

By means of the afore-mentioned solution there can be ensured an effective venting effect in the outer chamber, while an effective closing off of the inner chamber can be provided, so that penetration of moisture into the inner chamber can be prevented and with the aid of simple means access can nevertheless be obtained to the inner chamber when there is need for this.

Should a ventilation fan be required or generally desirable, it is a further objective of the invention to admit such a fan in the ventilation cowl, so that the fan according to need and in a ready manner can be connected to one or more air ducts just in front of their outlet openings and just behind the outer chamber.

The cowl according to the invention is in this connection characterised in that the inner chamber includes a fan, the outlet union of which is supported by the partition wall between the outer chamber and the inner chamber, one or more air duct(s) emptying into the inner chamber just by the inlet opening(s) of the fan.

By arranging a fan according to the invention in the inner chamber provision can be made for an effective airing of the inner chamber, even if this is closed off from the outer chamber. In addition one can obtain a rational utilisation of the fan, since this can be connected according to desire and need to a chamber which can serve a single air duct or can be common to a vent chamber from two or more aid ducts, the fan having the possibility to exhaust the vented air directly outside the chamber in which the fan is placed and can thereby employ almost the whole power of the fan for suction effect and only minimally having a need for the effect of pressure.

Further features of the invention will be evident from the following description, in which there is to be described a couple of embodiments of the solution according to the invention having regard to the accompanying drawings, in which.

Figure 1:
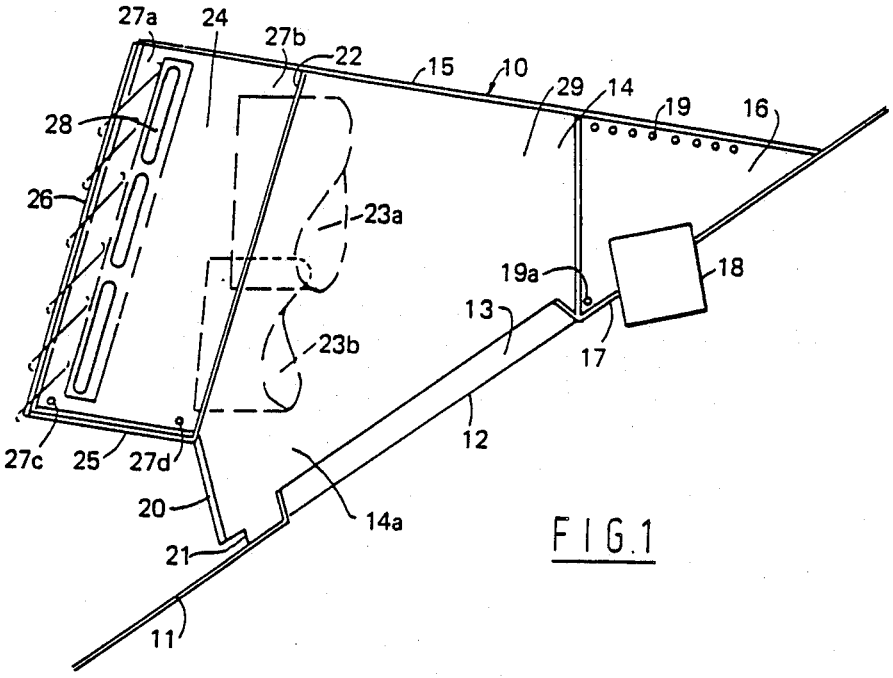
FIG. 1 shows schematically a vertical longitudinal sketch of the ventilation cowl according to the invention according to a first embodiment.
Figure 2:
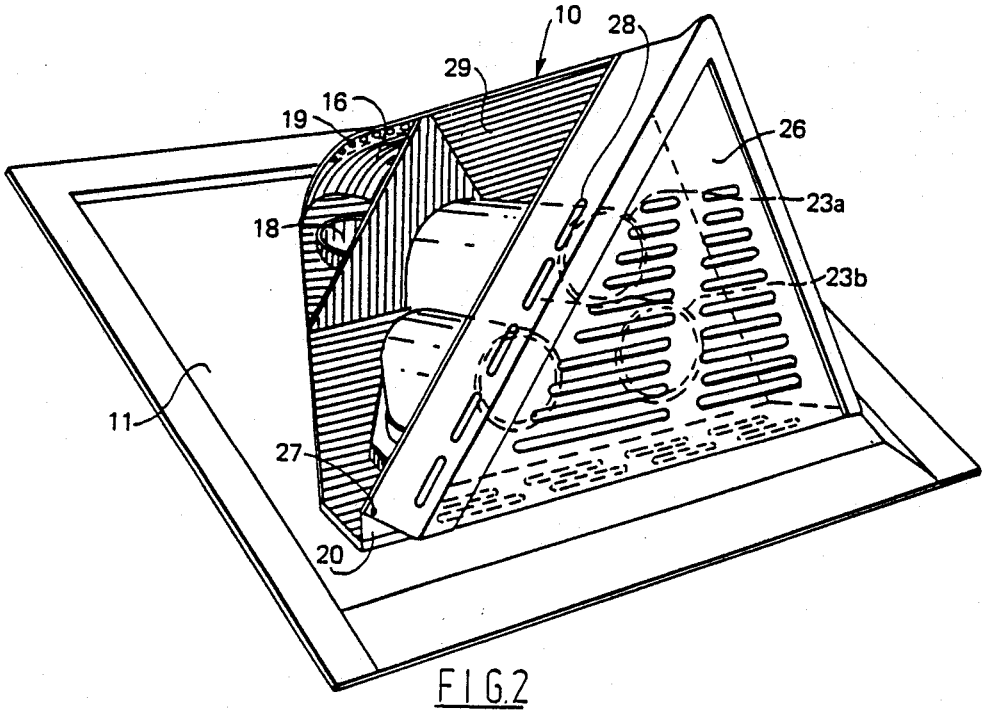
FIG. 2 shows the same as in FIG. 1 illustrated in perspective.

A ventilation cowl 10 according to FIGS. 1 and 2, which can be made of plastic or if desired of metal, comprises a plate-shaped member 11 for mounting on the roof of a house. In the plate-shaped member 11 there is designed an opening 12 which is defined by an upwardly projecting water blocking edge or flange 13, the function of which is to prevent water which runs downwards along the plate-shaped member 11, from running through the opening 12 and down into the underlying space beneath the roof of the house.

The opening 12 and portions of the plate-shaped member 11 around the opening 12 are covered by a superstructure 14, which can be secured in one piece to the plate-shaped member, that is to say welded, glued or fixed to the latter in a releasable manner. The superstructure 14 has in the illustrated embodiment a pyramid-like design, which is reminiscent of an attic in a house, and its upper edge or ridge 15 forms an angle with the plate-shaped member 11. The pyramid shape is chosen in order to guide rain and specially snow laterally away from the upper and rear portions of the cowl.

In the upper end of the superstructure 14, that is to say in the right end of FIG. 1, there is arranged a chamber 16 which is closed off from the space in the remainder of the superstructure. Through the bottom 17 in the chamber 16 there projects a pipe union 18 which also projects through the plate-shaped member 11 and down through the roof of the house for coupling to a discharge air pipe (not shown). The upper orifice of the pipe union 18 is terminated at a level below the upper edge or the ridge 15, so that the discharge air empties into the chamber 16 and from there flows outwards to the outside air via laterally directed apertures or holes 19, which produce a draft effect and make possible pressure equalization in the chamber 16 and the escape of water vapour from this to the outside air. The condensate in the chamber 16 drains out through one or more holes **19*a* at the lowermost point in the cowl 10 at the bottom 17**, directly to the outside air.

In the opposite end of the cowl, that is to say to the left in FIG. 1, the superstructure is defined by an end wall 20 which projects obliquely upwards from the plate-shaped member 11 between obliquely extending side walls **14*a* of the superstructure 14. Between the lower edge of the end wall 20 and the plate-shaped member 11 there is a gap 21 where condensate which is formed in the superstructure can drain out to the outside air. From the upper edge of the end wall 20 and angled directly towards the ridge 15 there proceeds a vertically extending partition wall 22 with through pipe unions 23***a*, 23*b* fastened thereto, which are adapted to be connected to their respective air ducts which pass through the opening 12 in the house roof. The pipe unions 23*a*, 23*b* are obliquely positioned relative to the vertically extending partition wall, so that the outer ends of the pipe unions extend obliquely outwards and downwards on the outer side of the partition wall, that it to say in a chamber 24 which is defined outside the partition wall 22. In this way provision is made for guiding the bulk of possible condensation on the pipe unions outwardly from the pipe unions and out into the chamber 24.

The chamber 24 is defined just above the end wall 20 between the partition wall 22 and a lower extension 25 of the end wall 20 extending obliquely upwards and outwards and an outer wall 26 which passes parallel to the partition wall 22 a distance in front of the end wall 20, together with upwardly converging side walls which are aligned with side walls 14*a* of the superstructure 14.

In the illustrated embodiment the chamber 24 is included in a unit which comprises the walls 22, 25, 26 and the pipe unions 23*a*, 23*b* together with the walls which run parallel to side walls 14*a* of the superstructure 14. The unit can be pushed endways into place along the side walls of the superstructure 14 forwards to the end wall 20 and fastened to the side walls 14*a* of the superstructure with screws 27*a*, 27*b*, 27*c*, 27*d*. In this way there is obtained in a simple manner ready access to a chamber 29 which is defined within the chamber 24, after the ventilation cowl 10 is ready mounted on the house roof by removing the partition wall 22, so that air ducts can be readily coupled to the unions 23*a* and 23*b*.

In the side walls of the unit there are designed laterally directed air apertures 28, while in the bottom of the extension 25 there are designed (not shown further) equivalent downwardly directed air apertures or similar air openings. The wall 26 is made in this embodiment in the form of a grill and with ventilation apertures associated with this. By means of the air apertures 28 in the side walls of the unit and the openings in the extension 25 together with the openings in the grill-shaped wall 26 provision can be made for sufficient airing of the chamber 24 and sufficient draft action in the chamber 24 so that the ventilation cowl functions satisfactorily, even without fans connected to the ventilation installation. At the same time rain water or other moisture can be prevented from being led into the chamber 29 inside the chamber 24 and condensate which is formed in the chamber 24 prevented from draining into the chamber 29 and further through the opening 12 to the space below the house roof.

In the illustrated embodiment one has a ventilation cowl 10 where several (there are indicated three in number) air ducts are gathered in one and the same ventilation cowl, with outlets separate from each air duct. The pipe union 18 can for example be connected to an air duct from the waste discharge system of the house or from certain moist spaces of the house (W.C., wash room. and the like), while the pipe unions 23*a*, 23*b* can be connected to their respective spaces, for example bathroom kitchen or the like.

Figure 3:
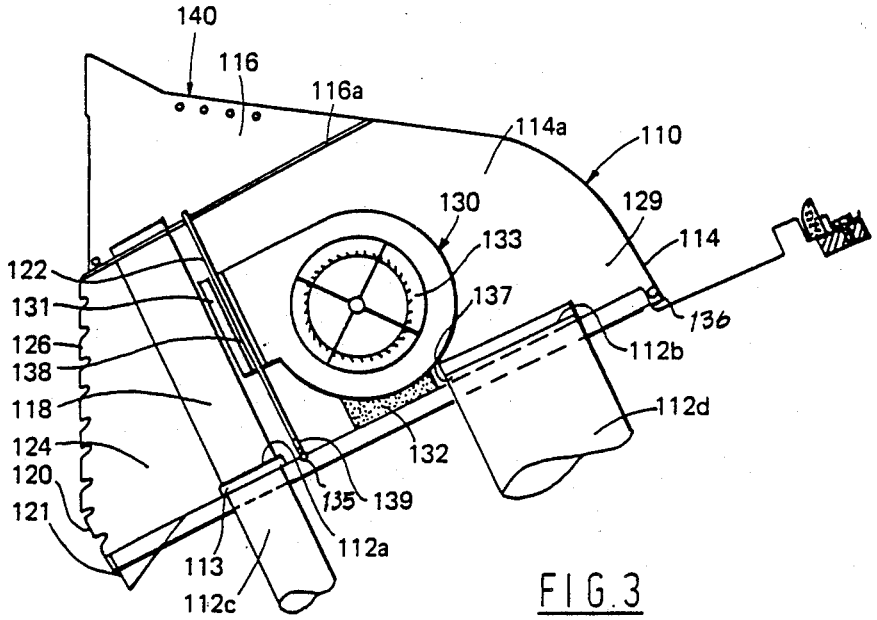
FIG. 3 shows in a corresponding longitudinal section as shown in FIG. 1 the ventilation cowl according to the invention according to a second embodiment.
Figure 4:
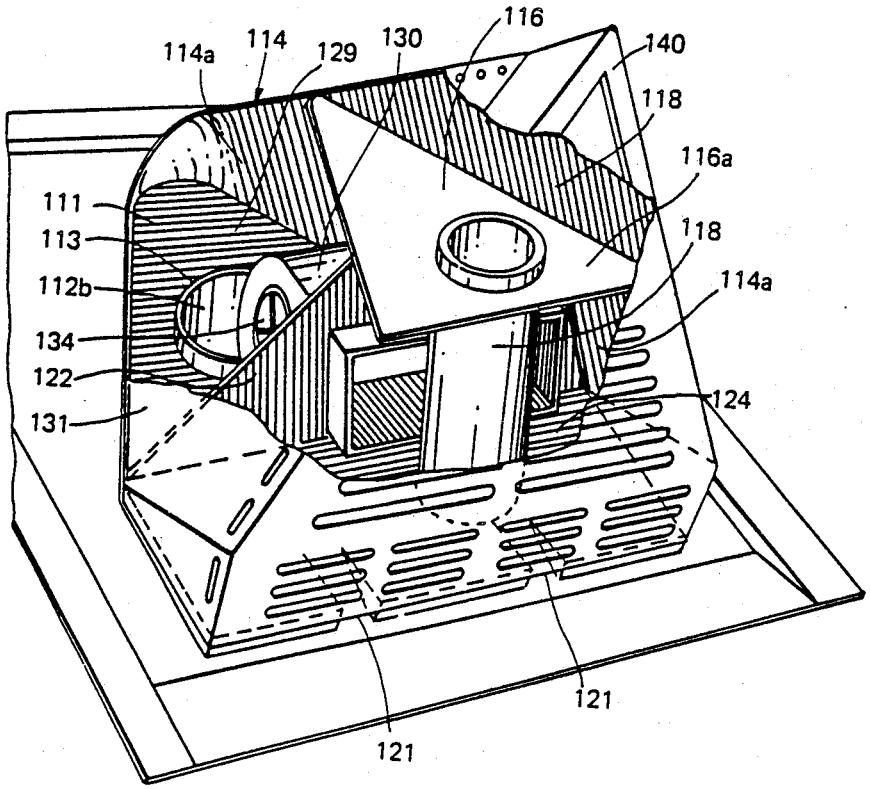
FIG. 4 shows the same as in FIG. 3 illustrated in perspective.

In FIGS. 3 and 4 there is shown an alternative construction, where the ventilation cowl 110 is provided with a plate-shaped member 111 and a superstructure 114.

The plate-shaped member 111 is provided with two openings 112*a* and 112*b*, that is to say an opening for each respective discharge duct 112*c* and 112*d*. In a manner similar for the opening 12 in FIG. s1 and 2 the openings 112*a* and 112*b* are defined with an upwardly projecting water blocking edge or flange 113.

According to FIGS. 3 and 4 there is defined in the superstructure 114 an upper chamber 116, corresponding to the chamber 16 in FIGS. 1 and 2, arranged on the upper side of a forward, outer chamber 124 and a rear, inner chamber 129. The chambers 124 and 129 are mutually separated from each other by means of an approximately vertical or upwardly oblique and outwardly extending partition wall 122, while the chambers 124 and 129 are separated from the chamber 116 by means of an approximately horizontal or downwardly oblique and outwardly extending partition wall 116*a*. The discharge duct 112*d* or the ducts from certain spaces empty out into the chamber 129 just above the associated opening 112*b* at the bottom of the chamber 129, while the discharge duct 112*c* which is connected to a discharge union 118 which passes through the chamber 116 and the chamber 124, passes through the opening 112*a* which is designed in the bottom of the chamber 124.

In the embodiment which is shown in FIGS. 3 and 4 the chamber 129 is employed for the reception of a fan 130 which has an associated discharge union 131 projecting through the partition wall 122 to a region in the chamber 124 just behind the discharge union 118. In this way the discharge union 118 can form an effective guide means for dispersing the discharge air which is blown out from the fan 130. In the back edge the fan 130 is supported on a rubber pedestal 132 or like vibration and noise-dampening support means, which is fastened to the plate-shaped member 111. Through an opening not shown in the plate-shaped member, there can be guided centrally through the rubber pedestal 132 current conductors (not shown) for the fan to the space beneath the house roof, the rubber pedestal forming a seal around the lower portion of the fan and against the plate-shaped member, that is to say around the opening in the rubber pedestal and the plate-shaped member. Inlet openings of the fan, as shown at 133 in FIG. 3 and at 134 in FIG. 4, are disposed in the illustrated embodiment on their respective sides and just above and just beyond the opening 112*b* in the bottom member 111 and just above and just beyond the opening from the air duct 112*d* or the ducts which are received in the opening 112*b*.

There is employed an almost wholly sealed off fan chamber 129, the partition wall 122 being sealed off with a rubber seal 135 along the peripheral edge of the partition wall, that is to say along the side walls 114*a* of the superstructure 114, along the roof-forming portion (at 116*a*) of the chambers 124 and 129 and along the plate-shaped member 111, while the superstructure 114 is sealed along the periphery of the plate-shaped member 111 with a rubber seal 136. The discharge duct 112*d* or the ducts, which empty out at the opening 112*b*, are correspondingly sealed off with a rubber seal 137 against the upwardly projecting edge or flange of the opening 112*b*. Discharge union 131 of the fan 130 can correspondingly be connected to the partition wall 122 via a rubber seal 138.

In order to ensure expelling of possible condensate which is necessarily formed internally in the chamber 129 there is arranged in the lower edge portion of the partition wall 122 a pair or a series of drain openings 139, with opening diameters of some few mm, emptying directly into the chamber 124. From the chamber 124 possible condensate is emptied outwards from the ventilation cowl via a gap 121 at the lower edge portion of the end wall 120.

The superstructure 114 according to FIGS. 3 and 4 is designed with an end wall 120 which extends in one piece with the outer wall 126 with the associated grill openings In the illustrated embodiment the whole superstructure 114, including the pipe union 118, end wall 120, outer wall 126, side walls 114*a* and an approximately pyramid-shaped top member 140, can be readily dismantled relative to the plate-shaped member 111 and the partition wall 122 with associated fan 130 fastened to the partition wall 122, so that full access to the fan and to the region which is defined in the chamber 129 is obtained. In the illustrated embodiment the pyramid-shaped top member, including the partition wall 116*a*, which forms the roof of the chambers 124 and 129 together with the associated pipe union 118, is readily releasably fastened to the main portion of the superstructure 114 in which the side walls 114*a*, the end wall 120 together with the outer wall 126 are included, so that one can get access to the chambers 124 and 129 without having to dismantle the main part of the superstructure.

By arranging the outlet from the discharge union 118 at an uppermost level of the ventilation cowl and at a level significantly above the outlets in the outer wall 126, there is obtained an effective "natural" venting from the discharge union 118 and in addition an extra venting effect in the discharge union 118 caused by the exhaust air which is expelled from the fan via the openings in the outer wall 116.

I claim:

1. A ventilation cowl comprising a plate-shaped member having a pair of openings therein for passage of air ducts therethrough;

a superstructure mounted on said plate-shaped member in overlying relation to said openings;

a partition wall within said superstructure sealingly separating an inner chamber in communication with one of said openings in said plate-shaped member from an outer chamber in communication with the other of said openings;

a plurality of drain openings in a lower edge of said partition wall for passage of condensate from said inner chamber;

an outer wall within said superstructure spaced from said partition wall to define said outer chamber, said outer wall having a plurality of apertures for passage of air therethrough;

at least one outlet union mounted in said partition wall, said union being directed towards said outer wall; and a fan in said inner chamber, having an intake opening in communication with said inner chamber and an outlet opening in communication with said outlet union in said partition wall.

2. A ventilation cowl as set forth in claim 1 wherein said superstructure includes a pair of walls connected with said outer all to define a unit releasably secured to the remainder of said superstructure to provide access to said partition wall.

3. A ventilation cowl as set forth in claim 1 further comprising a third wall within said superstructure separating said inner chamber from a third chamber, and a pipe union passing through said plate-shaped member into said third chamber for connection to an air duct from a waste system, said superstructure having air outlets communicating with said third chamber for venting thereof.

4. A ventilation cowl as set forth in claim 3 wherein said superstructure has a condensate drain hole at a lower end of said third chamber.

5. A ventilation cowl comprising a plate-shaped member having at least one opening therein for passage of an air duct therethrough;

a superstructure mounted on said plate-shaped member in overlying relation to said opening;

a partition wall within said superstructure separating an inner chamber in communication with said opening in said plate-shaped member from an outer chamber;

an outer wall within said superstructure spaced from said partition wall to define said outer chamber, said outer wall having a plurality of apertures for passage of air therethrough;

at least one outlet union for connection to an air duct passage through said opening of said plate-shaped member, said union being mounted in said partition wall on a downwardly inclined angle to vent air from the air duct;

a third wall within said superstructure disposed over said inner chamber and said outer chamber to define a cover therefor and separating said inner chamber from a third chamber; and a pipe union passing through said plate-shaped member into said third chamber for connection to an air duct from a waste system, said superstructure having air outlets communicating with said third chamber for venting thereof.

6. A ventilation cowl as set forth in claim 5 wherein said superstructure has a condensate drain aperture at a lower end of said inner chamber.

7. A ventilation cowl as set forth in claim 5 which further comprises a fan in said inner chamber, said fan having an intake opening in communication with said inner chamber and an outlet opening in communication with said outlet union in said partition wall.

* * * * *

UNITED STATES PATENT AND TRADEMARK OFFICE

CERTIFICATE OF CORRECTION

PATENT NO. : 4,890,546

DATED : Jan. 2, 1990

INVENTOR(S) : VIDAR VENGE

It is certified that error appears in the above-identified patent and that said Letters Patent is hereby corrected as shown below:

Column 4, line 8 "Fig. sl" should be -Figs. 1-
Column 6, line 10 "all" should be -wall-
Column 6, line 38 "passage" should be -passing- Signed and Sealed this Eleventh Day of June, 1991

*Attest:*

*Attesting Officer*

HARRY F. MANBECK, JR.

*Commissioner of Patents and Trademarks*